US010640889B2

(12) United States Patent
Xu et al.

(10) Patent No.: US 10,640,889 B2
(45) Date of Patent: May 5, 2020

(54) METHOD TO FORM YARN VIA FILM FIBERIZING SPINNING

(71) Applicant: Wuhan Textile University, Wuhan, Hubei (CN)

(72) Inventors: Weilin Xu, Hubei (CN); Zhigang Xia, Hubei (CN); Xin Liu, Hubei (CN)

(73) Assignee: Wuhan Textile University, Wuhan, Hubei (CN)

( * ) Notice: Subject to any disclaimer, the term of this patent is extended or adjusted under 35 U.S.C. 154(b) by 80 days.

(21) Appl. No.: 15/936,438

(22) Filed: Mar. 27, 2018

(65) Prior Publication Data

US 2018/0216254 A1 Aug. 2, 2018

(30) Foreign Application Priority Data

May 11, 2017 (CN) ..... 2017 1 0329749

(51) Int. Cl.

| | |
|---|---|
| ***D01D 5/42*** | (2006.01) |
| ***D02G 3/06*** | (2006.01) |
| ***D01D 10/02*** | (2006.01) |
| ***D01D 5/16*** | (2006.01) |
| ***B26D 1/22*** | (2006.01) |

(52) U.S. Cl.

CPC ..... *D01D 5/426* (2013.01); *B26D 1/225* (2013.01); *D01D 5/16* (2013.01); *D01D 10/02* (2013.01); *D02G 3/06* (2013.01)

(58) Field of Classification Search

CPC ..... D01D 5/426; D01D 5/16; D01D 5/42; D01D 5/423; D01D 10/02; B26D 1/22; B26D 1/225; D02G 3/06; D02G 3/02; D01G 1/06; D01H 13/28; D01H 1/02

USPC ..... 57/260, 75, 31

See application file for complete search history.

(56) References Cited

U.S. PATENT DOCUMENTS 2,312,173 A * 2/1943 Johnstone ..... B26D 1/225 83/469

2,321,726 A * 6/1943 Alderfer ..... D02G 3/32 57/31

(Continued)

FOREIGN PATENT DOCUMENTS

| | | | | |
|---|---|---|---|---|
| CA | 910032 | * | 9/1972 | ..... B26D 1/225 |
| FR | 1450585 A | * | 6/1966 | ..... B29C 55/065 |
| GB | 1233713 A | * | 5/1971 | ..... D01D 5/423 |

*Primary Examiner* — Shaun R Hurley

*Assistant Examiner* — Patrick J. Lynch

(57) ABSTRACT

A method to form yarn via film fiberizing spinning belongs to a textile technical field. A film cutting device is arranged behind each drafting system on a ring frame, whose cut resistance apron and cutting roller engage with each other to form a cutting zone to cut and fiberize the film to get belt-like multi-filaments. Then the multi-filament formed passes through the first, second and third drafting zones in sequence for drawing, in such a manner that the multi-filament molecular orientation and crystallization are improved. After being drafted, the multi-filaments are twisted into yarn by ring spinning, which provides a novel high-efficient and short-processing way of producing yarns of nano-micro fibers using films instead of conventional nano-spun fibers such as electro- and centrifugal spun fibers, thereby breaking restriction of "low bulk and low-speed production of nano-spun fibers" and integrating the film industry with the textile industry.

3 Claims, 2 Drawing Sheets

(56) References Cited

U.S. PATENT DOCUMENTS

| | | | | | |
|---|---|---|---|---|---|
| 3,596,816 | A * | 8/1971 | Brown | D01D 5/423 | 225/2 |
| 3,606,115 | A * | 9/1971 | Matsui | D01D 5/423 | 225/97 |
| 3,624,996 | A * | 12/1971 | Shepherd et al. | B66B 1/24 | 57/408 |
| 3,761,552 | A * | 9/1973 | Chill | B29C 48/19 | 264/37.28 |
| 3,927,957 | A * | 12/1975 | Chill | B29C 55/065 | 425/131.1 |
| 4,098,864 | A * | 7/1978 | Morris | D01D 5/16 | 264/289.3 |
| 4,845,813 | A * | 7/1989 | Salaun, Jr. | D01H 5/22 | 19/258 |
| 6,428,891 | B1 * | 8/2002 | Okuya | D01F 6/18 | 264/206 |
| 2007/0243378 | A1 * | 10/2007 | Cho | D01D 5/16 | 428/375 |

* cited by examiner

METHOD TO FORM YARN VIA FILM FIBERIZING SPINNING

CROSS REFERENCE OF RELATED APPLICATION

The present invention claims priority under 35 U.S.C. 119(a-d) to CN 201710329749.4, filed May 11, 2017.

BACKGROUND OF THE PRESENT INVENTION

Field of Invention

The present invention relates to a method to form yarn via film fiberizing spinning which belongs to a textile technical field.

Description of Related Arts

Textile fibers can be divided into natural fibers and chemical fibers by source; wherein chemical fibers generally include regenerated fibers and synthetic fibers. Among them, man-made fibers such as regenerated cellulose fibers, various viscose fibers, etc., are made by chemical re-aggregating natural polymers into a fibrous form to meet the textile processing requirements as the natural polymer macroscopic aggregation features such as length and thickness cannot meet the requirements of textile processing; the synthetic fibers are formed via converting chemical polymers synthesized from petrochemical small molecules into chemical filament during spinning process. Chemical filament production, according to polymer properties, can be divided into melt spinning and solution spinning. The melt spinning takes advantage of polymer materials which has an obvious melting point and a melting temperature below a decomposition temperature; wherein the process comprises preparation of spinning melt (including melt slicing, melt drying, etc.) - - - the melt is fed into the twin-screw extruding high temperature melt spinning machine, and heated into hot melt fluid - - - the hot melt fluid is extruded from spinneret holes - - - stretch and solidification of the melt stream - - - wetting and oiling - - - winding. Shaped filaments are generally multi-filaments, containing at least hundreds of mono-filaments, and cannot directly used in textile processing, which general needs to be processed with dividing - - - secondary heat drafting and forming - - - false twisting or air texturing and other processing - - - winding. After processing, the linear assembled filaments with cylindrical cross-section shape can be used for a variety of composite spinning. Obviously complex processes are required to get the melt spun filaments for textile processing, wherein a process flow is long and production efficiency is low. Solution spinning is for polymer material with no obvious heat melting point or its melting temperature higher than its decomposition temperature, wherein the polymer is dissolved in an appropriate solvent to form a spinning solution - - - filtering and defoaming and mixing before the spinning solution is placed in the solution tank of the solution spinning machine - - - the spinning solution is pushed out of the spinneret holes and solidified into fibers in coagulation bath (including a wet method and a dry method) to get undrawn filaments - - - stretching and solidifying the undrawn filaments - - - washing for removing the attached coagulation bath liquid and solvent - - - wetting and oiling - - - winding. The wound-formed filaments are generally multi-filaments, containing at least hundreds of filaments, and cannot be used directly in the textile processing, which general needs to be processed with dividing - - - secondary heat drafting and forming - - - false twisting or air texturing and other processing - - - winding. Although the filament cross section is adjustable according to the spinneret hole shape, the filaments with a linear cylindrical assemblage shape can be used for a variety of composite spinning. Obviously complex processes are required to get the solution spun filaments for textile processing, wherein a process flow is long and production efficiency is low. Therefore, conventional filament fiber formation generally employs spinneret with holes to perform linear extruding fiber forming, which requires long process flow and complex equipment.

The above is the current production method as well as process of conventional textile fibers. With the continuous development of nanofiber materials' application technology in various fields, nanofiber forming technologies have also been further developed and innovated. So far, nanofibers' production methods mainly include the chemical, phase separation, self-assembly and spinning method. The spinning method is considered as the most promising for producing polymer nanofibers in large scale, including electrospinning, two-component composite spinning, melt blowing and laser stretching. The laser stretching method, which belongs to a post-processing of conventional filaments, employs laser irradiation to heat fibers and ultrasonic condition for a mechanical stretching of fibers simultaneously, resulting in about 105 times the stretching ratio for creating nanofibers. In addition, all other nanospinning methods related with spinnerets are common in that: spinneret extrusion and mechanical drafting are synergic conducted to attenuate fiber diameter to nanoscale. The nanofibers with diameters ranged from 1 nm to 100 nm are advanced in high porosity, large specific surface area, large aspect ratio, high surface energy and high activity, result in excellent functions including anti-bacterial, water-repellent and filtration for applications in filtration, biomedicine, polymer enhancement, photoelectric sensing and other fields. However, the nanofibers are too thin to have satisfied high strength and abrasion properties for conventional drawing and twisting process to form spun yarn; instead nanofibers are usually used to form film through web processing in a small amount. The nanofiber web can be coated on fabric and other textile product surface; however, the coating is poor in durability due to nanofiber surface energy so high to insult poor adhesion and durability. To solve aforementioned nanofiber application problems, only after conversion of nanofibers into macro yarn, conventional textile methods could be applied to produce various functional textile products such as medical, industrial and apparel fabrics, which will improve conventional textile performance and value, and broaden conventional textile applications. Currently, the conversion of nanofibers into macro yarn are mainly these trials of pure nano-yarn processing technologies: Chinese patent "Nanofiber yarn, tape and board manufacturing and application", application No. ZL201310153933.X, published Nov. 9, 2005, discloses a method for drafting and twisting nanofibers with a ribbon or plate-shaped carbon nanotube array disposed in parallel, and then applying the nanoribbons or yarns for the composite-reinforced organic polymer to fabricate an electrode, optical sensors and other fields; Chinese patent "Oriented nanofiber yarn continuous preparation device and method", application No. ZL201310454345.X, published Sep. 27, 2013, uses a spinning-twisting device for directly twisting and winding the produced nanofibers into a linear material. Actually, nanofibers themselves are too thin in shape and weak in strength.

In particular, carbon nanofibers have the characteristics of easy brittleness, which leads to serious fiber damage and destruction during twisting of the nanofibers. Therefore, practical results validate that nanofibers are easy to be broken when being twisted with their advantages buried; the spun nanofiber yarn is far below the expected theoretical effect. To solve the technical problems and bottlenecks of pure nanofiber yarns, Chinese patent "Spinning device and spinning method of nanofiber and filament composite yarn", application No. ZL201210433332.X, published Nov. 1, 2012, provides a method for introducing a filament onto two nanofiber receiving discs during electrospinning, in such a manner that the nanofiber is adhered to two nanofilaments which are then combined by twisting, so as to obtain filament/nanofiber composite yarn with a ultra-high specific surface area of the nanofibers and the high-strength characteristics of the filaments. Although the patent overcomes the problem that the nanofibers are too weak to be purely spun into yarn, it only involves twisting filaments and nanofibers into yarn ignoring the large amount of natural and chemical staple fibers used for conventional large-scale textile processing. Therefore, the patent involves a narrow range of processing applications, without solving and realizing nanocomposite spinning production of conventional staple fibers in the textile industry. Based on the above technical problems and bottlenecks, in particular, the technical requirements for the production of composite yarns from nanofibers and conventional cotton fibers, Chinese patent, "Method for Preparing a Nanofiber Blended Composite Yarn", application number ZL201310586642.X, published Nov. 20, 2013, discloses that during a carding process, electrostatic nanospun fibers are directly sprayed onto and mixed with the cotton web outputting from a card machine to form cotton/nanofiber strip; and then the strips are converted into a composite yarn after roving, and spinning processes. This method seems to be simple and effective to combine nanofibers and cotton fibers together. However, serious inherent principle default and actual production problems are still existed for the method: the key issue is that nanofibers with large specific surface area are easy adhered with conventional cotton fibers and nanofibers themselves. In this case, during roving and the spinning, the cotton fibers are hard to freely and smoothly slide relative to each other, causing excessive fiber hooks, difficult and uneven drafting; thus the resultant nanofiber/cotton composite yarn has a low qualities, indicating the patent method failure in produce high-performance and high-quality nanocomposite yarn. Chinese Patent "Method for preparing nanofiber by coating on the surface of yarn or fiber bundle and system", application No. ZL201110221637.X, published Aug. 4, 2011, provides that when the yarn passes between the nozzle of the spinneret and the collector, the surface of the yarn is directly sprayed by the nano-spinneret to form a layer of nano-coating film. Obviously, this application relates to nanofiber spraying and coating, wherein nanofibers cannot enter into the yarn body and cannot create good cohesion with the short fibers inside the yarn; this inevitably leads to a poor durability inevitably allowing the nano-coating layer detaching and wearing off the yarn surface during subsequent processing and usage. Apart from the thin diameter, the weakness of nanofibers is also ascribed to poor orientation of the macromolecules in the nanofibers as the drafting is insufficient during nanofiber production; the insufficient drafting also incurs unsatisfied fineness of the nanofibers. The weak strength and unsatisfied fineness are crucial to cause poor adhesion and durability of nanofiber coatings, prohibit the pure nanofibers directly twisted into textile yarn by conventional ring spinning. As a result, only a small amount of nanofibers are commercially processed into non-woven fabrics or nanofilms for industrial application; the failure of the large-volume and high-speed production of nanofiber yarn seriously restricts nanofibers application in the apparel and other potential textiles.

Different from the spinning process, the film forming process is to convert polymer materials into the form of a sheet and wind the sheet into a roll. There are various methods for forming the plastic film, such as the rolling method, the casting method, the blow molding method, stretching method, etc. According to above methods, the plastic film production employs an external force to orientate and arrange the polymer inner chain or crystal in parallel to the film surface within an appropriate temperature range (high-elastic state) of above the glass transition temperature and below the melting point; then a film-like profile is formed. Subsequently, heat-setting is adopted for the tensioned film profile to fix the oriented macromolecular structure which is then cooled, pulled, and winded. During the process of film blow molding, according to different extrusion and traction directions, it can be divided into three types: flat blowing, up blowing and down blowing. There are also special blow molding methods such as up extruding up blowing. Film material has many special features: 1) the most basic performance of the film material is a flat appearance with clean surface and no dust or oil; 2) the thickness and length of the standard specifications are controllable, wherein the thickness can be as low as nanoscale, and the width can be precisely controlled at the macro millimeter scale, effectively ensuring the mechanical strength of the fiber film, and precise stabilization of film shape size so that the specifications of each film material deviations are in line with customer requirements; 3) for the transmittance and gloss according to customer requirements for different production, high transmittance may be maintained according to transmittance requirement, but the gloss must be maintained for bright and beautiful effects; 4) tensile strength, elongation at break, tearing strength, impact strength and so on are easy to achieve compliance; 5) according to use, application and performance, the processed film can have various shape sizes, different specifications of the meshes, cracks, etc., giving the film material excellent moisture permeability and air permeability; 6) size and chemical stability, as well as surface tension are easy to reach high standards. The widely used film materials have many types, such as polymer film material, aluminum film material, microporous film material, which are mainly used in the packaging of food, medicine and cosmetic products, the filter purification of air and water, the filtration of virus and dust, and so on. It can be seen that the conventional film is basically not used for the production of textile yarn and fabric, wherein the key issue is: the relatively stable film is difficult to be freely migrated and hugged together; therefore direct twisting of the film material cannot get the migration and coherence structure of conventional filaments and staple fiber spun yarns by twisting, leading to appearance and feel performance of the film spun yarn are quite different from that of conventional filaments and staple fiber spun yarns.

SUMMARY OF THE PRESENT INVENTION

In order to solve such problems as that the complication and high costs of conventional spinning with spinneret holes, the failure of high-effectively gathering nanofibers as a linear form, and structural differences between a twisted film linear material and a conventional fiber spun yarn, an object of the present invention is to provide a method to form yarn via film fiberizing spinning.

Accordingly, in order to accomplish the above object, the present invention provides a method to form yarn via film fiberizing spinning, comprising steps of: arranging a film cutting device behind each drafting system on a ring frame, wherein the drafting system comprises a rear roller, a rear rubber roller, a middle roller, a middle rubber roller, a front roller, and a front rubber roller; the film cutting device comprises a bearing roller, an unwinding roller and a cutting roller; a cut resistance apron is wrapped onto the unwinding roller; loop blades, which are arranged in parallel, are located on the cutting roller circumference; the cut resistance apron corresponds to cutter edges of the loop blades located on the cutting roller; a cutting zone is formed between the cut resistance apron and the cutting roller; the cutting area center and the rear rubber roller center, the middle rubber roller center and the front rubber roller center are in a same plane; the rear rubber roller and the rear roller of the drafting system engage with each other to form a rear roller nip; a first drafting zone is formed between the cutting zone and the rear roller nip; a filament guider is provided in the first drafting zone; the extended line of an input end of a guiding tunnel of the filament guider is tangent with the cutting zone; the extended line of an output end of the guiding tunnel of the filament guider is tangent with the rear rubber roller at the rear roller nip; the middle roller and the middle rubber roller of the drafting system engage with each other to form a middle roller nip; a second drafting zone is formed between the rear roller nip and the middle roller nip; a first heater is provided in the second drafting zone; a heating groove of the first heater is parallel to an axis of the rear roller nip and an axis of the middle roller nip; the front roller and the front rubber roller engage with each other to form a front roller nip; a third drafting zone is formed between the middle roller nip and the front roller nip; a second heater is provided in the second drafting zone; a heating groove of the second heater is parallel to the axis of the middle roller nip and an axis of the front roller nip;

during spinning, placing a film roll between the bearing roller and the unwinding roller, wherein films unwound from the film roll enter the cutting zone formed between the cut resistance apron and the unwinding roller; the cutting device cuts and fiberize the films to form belt-like multi-filaments which are evenly paved before entering the first drafting zone, wherein the multi-filaments get a primary drawing; after the primary drawing, the multi-filaments outputting from the rear roller nip via the filament guider enter the second drafting zone, wherein the multi-filaments heated in the heating groove of the first heater get a secondary drawing; after the secondary drawing the multi-filaments outputting from the middle roller nip enter the third drafting zone, wherein the multi-filaments heated in the heating groove of the second heater get a main drawing; after the main drawing, the multi-filaments outputting from the front roller nip are converged and twisted to form a yarn, subsequently the yarn passes through a pig-tail guider of yarn, a ring and a traveler successively, and is finally winding onto a yarn bobbin.

The cut resistance apron is made of ultra-high-strength polyethylene, aramid, or super high-strength rubber.

A distance between adjacent loop blade cutter edges is ranged from 0.1 mm to 3 mm.

Therefore, compared with conventional technologies, the method to form yarn via film fiberizing spinning of the present invention has advantages as follows: The film cutting device is arranged behind each drafting system on the ring frame, whose cut resistance apron and cutting roller engage with each other to form a cutting zone, wherein the film is cut and fiberized to form belt-like multi-filaments which are evenly paved for subsequent drafting and spinning, which changes the conventional way of producing filament fibers via linear extruding materials through the spinneret holes, overcomes such problems as process flow lengthiness, equipment complexity during the conventional way of filaments' production. Then the belt-like multi-filaments formed pass through the first, second and third drafting zones in sequence to conduct the primary, secondary and main drawings respectively for attenuation, resulting in each filament thickness changing from micrometer scale to micro-nano scale, from micro-nano scale to nanometer scale, and the from nanometer scale to even smaller scale. Meanwhile, inner molecular orientation and crystallization of the filaments are also improved, increasing the strength of the filaments and quickly achieving uniform and consistent high-yield output of the nano-filaments, so as to avoid the conventional nano-spinning route such as electro-spinning and centrifugal spinning. As a result, a problem that "insufficient drafting of filaments during the conventional nano-spinning incurs poor orientation of the macromolecules in the nano-fibers, unsatisfactory fineness of the nano-fibers, low strength of the nano-fibers, poor adhesion and durability of the nano-fibers. Therefore, nano-fibers overlaying onto the fabric surface are very easy to be worn off, and nano-fiber strands fail to be spun into a yarn by conventional ring spinning" is solved. The filaments attenuated by drawing in sequence are twisted into yarn through the conventional ring spinning, so as to rapidly produce yarn of nano-micro scale fibers in one step, effectively integrating the film industry and the textile and garment industry as functional films can be directly used to produce textile yarns of fibers in a high-speed and high-efficient way. Therefore, this invention takes in films as the expanded textile raw materials, and breaks restrictions of "conventional nano-spinning producing nano-fibers in low bulk and low-speed unable to meet the textile industrial application requirements", which provides an effective method for functional films to be used in the production and processing of yarn and apparel fabrics. The method of the present invention is convenient to operate and is easy to be popularized and applied widely.

These and other objectives, features, and advantages of the present invention will become apparent from the following detailed description, the accompanying drawings, and the appended claims.

DETAILED DESCRIPTION OF THE PREFERRED EMBODIMENT

Figure 1:
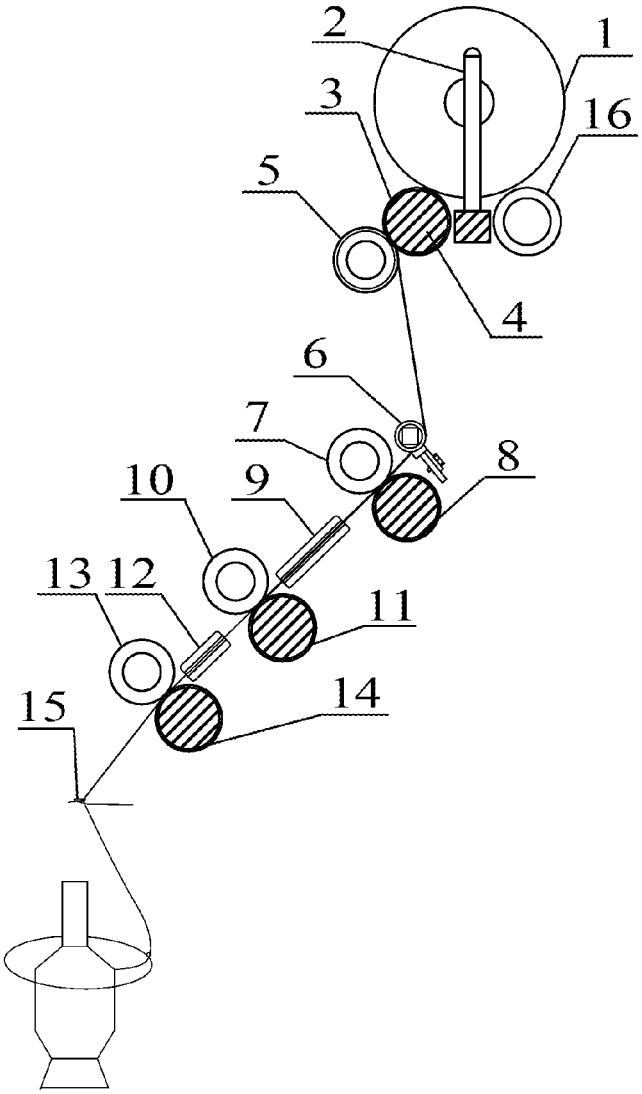
FIG. 1 is a sketch view of working principles of the present invention.
Figure 2:
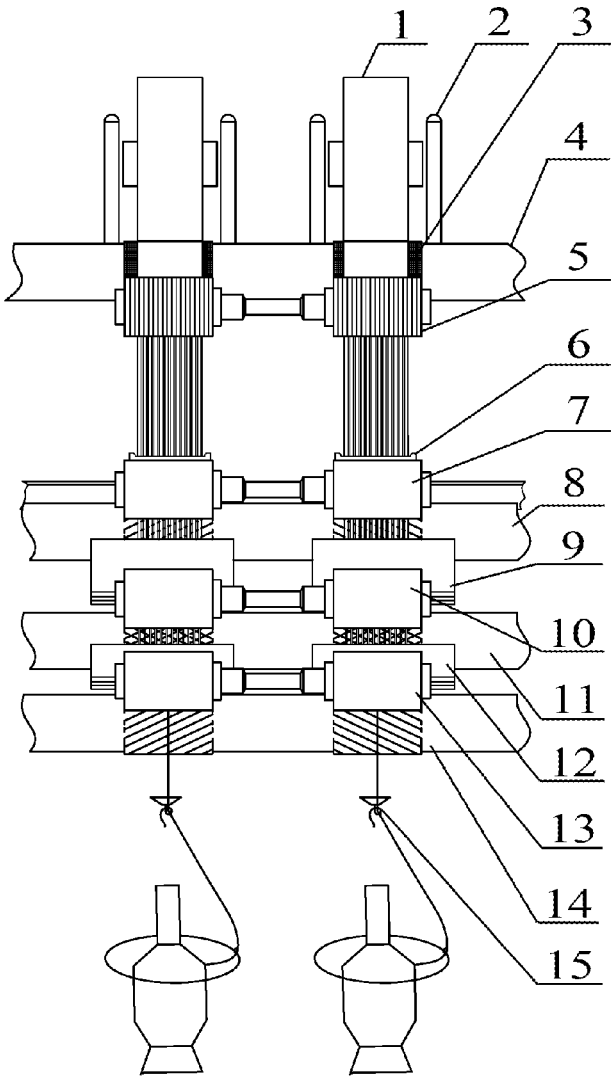
FIG. 2 is a sketch view of a film cutting device during working.

Referring to the drawings, a method to form yarn via film fiberizing spinning according to the present invention is further illustrated.

Please refer to the drawings.

The method to form yarn via film fiberizing spinning comprises steps of: arranging a film cutting device behind each drafting system on a ring frame, wherein the drafting system comprises a rear roller 8, a rear rubber roller 7, a middle roller 11, a middle rubber roller 10, a front roller 14, and a front rubber roller 13; the film cutting device comprises a bearing roller 16, an unwinding roller 4 and a cutting roller 5; separating rods 2 are provided between the bearing roller 16 and the unwinding roller 4, wherein each pair of the separating rods 2 correspond to the rear rubber roller 7 of each drafting system on the ring frame, so as to effectively limit films unwound from a film roll 1 into each drafting system on the ring frame; a cut resistance apron 3 made of ultra-high-strength polyethylene, aramid, or super high-strength rubber is wrapped onto the unwinding roller 4; loop blades, which are arranged in parallel, are located on the cutting roller 5 circumference, wherein a distance between cutter edges of adjacent loop blades is ranged from 0.1 mm to 3 mm; the shorter the distance between the cutter edges is, the thinner the belt-like multi-filaments formed by cutting and drafting will be; the cut resistance apron 3 corresponds to cutter edges of the loop blades located on the cutting roller 5; a cutting zone is formed between the cut resistance apron 3 and the cutting roller 5, whose width is no more than widths of corresponding rear, middle and front roller nips; the cutting zone center and the rear rubber roller 7 center, the middle rubber roller 10 center and the front rubber roller 13 center are in a same plane; a filament guider 6 is provided between the rear rubber roller 7 and the cutting roller 5, whose guiding tunnel is flat; the rear rubber roller 7 and the rear roller 8 of the drafting system engage with each other to form a rear roller nip; a first drafting zone is formed between the cutting zone and the rear roller nip; a filament guider 6 is provided in the first drafting zone; an extended line of an input end of a guiding tunnel of the filament guider 6 is tangent with the cutting area; an extended line of an output end of the guiding tunnel of the filament guider 6 is tangent with the rear rubber roller 7 at the rear roller nip; the middle roller 11 and the middle rubber roller 10 of the drafting system engage with each other to form a middle roller nip; a second drafting zone is formed between the rear roller nip and the middle roller nip; a first heater 9 is provided in the second drafting zone; a heating groove of the first heater 9 is parallel to an axis of the rear roller nip and an axis of the middle roller nip; the front roller 14 and the front rubber roller 13 engage with each other to form a front roller nip; a third drafting zone is formed between the middle roller nip and the front roller nip; a second heater 12 is provided in the second drafting zone; a heating groove of the second heater 12 is parallel to the axis of the middle roller nip and an axis of the front roller nip; the first heater 9 and the second heater 12 may adopts heaters disclosed in Chinese patent "Iron spinning device", publishing No. CN201234734, published May 27, 2009, or other heating forms such as resistance wires; when an iron spinning device is used, the first heater 9 and the second heater 12 are externally connected to a 24-36 v low-voltage safety power supply through wires;

during spinning, placing a film roll 1 between the bearing roller 16 and the unwinding roller 4, and between a pair of the separating rods 2, which means that both sides of the film roll 1 has one of the separating rods 2; wherein the films are organic polymer films, inorganic films, or organic-inorganic hybrid films; a width of the films are smaller than a width of the cutting zone, a thickness of the films are smaller than 1 mm; a smaller thickness of the films enables a thinner filament of the belt-like multi-filaments; the first heater 9 and the second heater 12 are externally connected to the safety power supply for heating internal walls of the heating grooves of the first heater 9 and the second heater 12 to 60-240° C.; when the films are the organic-inorganic hybrid films, the heating grooves of the first heater 9 and the second heater 12 are not heated, or the internal walls of the heating grooves of the first heater 9 and the second heater 12 are only heated to 60° C., so as to fully stretch and draw the belt-like multi-filaments after film fiberizing; when the films are the organic polymer films with an obvious glass-transition temperature, a larger thickness of the films means a higher glass-transition temperature, requiring a higher heating temperature, and vice versa; a higher drafting rate of the drafting zone requires a higher heating temperature, which is conducive to progressive thermal high-ratio drafting; wherein films unwound from the film roll 1 enter the cutting zone formed between the cut resistance apron 3 and the unwinding roller 4; in the cutting zone, the film cutting device cuts and fiberizes the films to form belt-like multi-filaments which are evenly paved before entering the first drafting zone, wherein the multi-filaments get a primary drawing for primary stretching and extending before a high rate drafting; after the primary drawing, the multi-filaments outputting from the rear roller nip via the filament guider 6 enter the second drafting zone, wherein the multi-filaments heated in the heating groove of the first heater 9 get a secondary drawing, wherein an inner consolidation structure of the polymer filaments with the obvious glass transition temperature become loosened so that each filament of the multi-filaments is in a high-elastic state and stretched by the secondary drawing, as a result, each filaments become attenuated and get inner molecular orientation and crystallization improvements; after the secondary drawing the multi-filaments outputting from the middle roller nip enter the third drafting zone, wherein the multi-filaments heated in the heating groove of the second heater 12 get a main drawing, wherein the inner consolidation structure of the polymer filaments with the obvious glass transition temperature is further loosened, so that each filament of the multi-filaments is completely in the high-elastic state, as a result, each filaments become further attenuated and get inner molecular orientation and crystallization further improvements, increasing the strength of the filaments and quickly achieving uniform and consistent high-yield output of the nano-filaments, so as to avoid the conventional nano-spinning route such as electro-spinning and centrifugal spinning. As a result, a problem that "insufficient drafting of filaments during the conventional nano-spinning incurs poor orientation of the macromolecules in the nano-fibers, unsatisfactory fineness of the nano-fibers, low strength of the nano-fibers, poor adhesion and durability of the nano-fibers. Therefore, nano-fibers overlaying onto the fabric surface are very easy to be worn off, and nano-fiber strands fail to be spun into a yarn by conventional ring spinning" is solved; after the main drawing, the multi-filaments outputting from the front roller nip are converged and twisted to form a yarn, subsequently the yarn passes through a pig-tail guider 15 of yarn, a ring and a traveler successively, and is finally winding onto a yarn bobbin; wherein various kinds of films can be fiberized, attenuated and twisted in one step for forming the yarn, effectively integrating the film industry and the textile and garment industry as functional films can be directly used to produce textile yarns of fibers in a high-speed and high-efficient way; Therefore this invention takes in films as the expanded textile raw materials, and breaks restrictions of "conventional nano-spinning producing nano-fibers in low bulk and low-speed unable to meet the textile industrial application requirements", which provides an effective method for functional films to be used in the production and processing of yarn and apparel fabrics.

Referring to the method to form yarn via film fiberizing spinning with different kinds of the films, embodiments of the present invention are further illustrated.

Embodiment 1

The method to form yarn via film fiberizing spinning with polyethylene terephthalate (PET) films.

A width of the PET films is 10 mm, and a thickness is 0.1 mm; the cut resistance apron 3 is made of the super high-strength rubber; the distance between cutter edges of adjacent loop blades is 0.1 mm; the first heater 9 and the second heater 12 are externally connected to a 36 v safety power supply, so as to heat the heating groove of the first heater 9 to 100° C. and the heating groove of the second heater 12 to 120° C. The method comprises steps of placing a film roll 1 of the PET films between the bearing roller 16 and the unwinding roller 4, wherein films unwound from the film roll 1 enter the cutting zone formed between the cut resistance apron 3 and the unwinding roller 4; cutting and fiberizing the films to form belt-like multi-filaments which are evenly paved before entering the first drafting zone; primary drawing the multi-filaments in the first drafting zone with a first drafting rate of 1.05 before entering the second drafting zone by the rear roller nip through the guiding tunnel of the filament guider 6; heating the multi-filament in the heating groove in the second drafting zone at 100° C., wherein inner macromolecules of each filaments are in a high-elastic state as the inner consolidation structure of the PET filaments is loosened; secondary drawing the multi-filament in the high-elastic state in the second drafting zone with a drafting rate of 4; then entering the third drafting zone by the middle roller nip; heating the multi-filaments in the heating groove in the third drafting zone at 120° C., wherein the inner macromolecules of the filaments are in the high-elastic state as the inner consolidation structure of the PET filaments is further loosened, so as to fully drawing with main drafting rate; main drawing the multifilament in the third drafting zone with a drafting rate of 30; then entering a twisting zone by the front roller nip; gathering and twisting the drafted multi-filaments to form a yarn, passing the yarn through a pig-tail guider 15 of yarn, a ring and a traveler successively, and is finally winding onto a yarn bobbin.

Twist degree of the yarn formed is 115 twists/m, and five polyester filaments are randomly removed from an inner of the yarn by untwisting, then the five polyester filaments are observed by a scanning electron microscopy; the observed results show that finenesses of the five polyester filaments are in a range of 806-862 nm, indicating that the produced yarn is constituted by ultra-fine polyester filament fibers.

Embodiment 2

The method to form yarn via film fiberizing spinning with polyamide (nylon) films.

A width of the polyamide films is 20 mm, and a thickness is 0.1 mm; the cut resistance apron 3 is made of the ultra-high-strength polyethylene; a distance between cutter edges of adjacent loop blades is 2.5 mm; the first heater 9 and the second heater 12 are externally connected to a 24 v safety power supply, so as to heat the heating groove of the first heater 9 to 120° C. and the heating groove of the second heater 12 to 150° C. The method comprises steps of placing a film roll 1 of the polyamide films between the bearing roller 16 and the unwinding roller 4, wherein films unwound from the film roll 1 enter the cutting zone formed between the cut resistance apron 3 and the unwinding roller 4; cutting the films for forming belt-like multifilament which are evenly paved before outputting to the first drafting area, primary drawing the multi-filaments in the first drafting zone with a drafting rate of 1.03 before entering the second drafting zone by the rear roller nip through the guiding tunnel of the filament guider 6; heating the multifilament in the heating groove in the second drafting zone at 100° C., wherein inner macromolecules of filaments are in a high-elastic state as the inner consolidation structure of the polyamide filaments is loosened; secondary drawing the multifilament in the high-elastic state in the second drafting zone with a drafting rate of 3; then entering the third drafting zone from the middle roller nip; heating the multi-filaments in the heating groove in the third drafting area at 120° C., wherein the inner macromolecules of the filaments are in the high-elastic state as the inner consolidation structure of the polyamide filaments is further loosened, so as to fully drawing with main drafting rate; main drawing the multi-filaments in the third drafting area with a third drafting rate of 35; then entering a twisting zone from the front roller nip; gathering and twisting the drafted multi-filaments to form a yarn, passing the yarn through a pig-tail guider 15 of yarn, a ring and a traveler successively, and is finally winding onto a yarn bobbin.

Twist degree of the yarn formed is 65 twists/m, and five polyamide filaments are randomly removed from an inner of the yarn by untwisting, then the five nylon filaments are observed by an optical microscopy; the observed results show that the filaments are thin and long in a branching form, and finenesses of the five polyester filaments are in a range of 800-970 nm, enabling producing yarn containing fine polyamide fibers.

Embodiment 3

The method to form yarn via film fiberizing spinning with polysulfone (PSF) films.

PSF films are nanofiber films whose nanofibers have a fineness range from 400 nm to 600 nm, belonging to thermoplasticity nanofiber unwoven films; a width of the PSF films is 22 mm, and a thickness is 0.1 mm; the cut resistance apron 3 is made of the aramid; a distance between cutter edges of adjacent loop blades is 3 mm; the first heater 9 and the second heater 12 are externally connected to a 36 v safety power supply, so as to heat the heating groove of the first heater 9 to 200° C. and the heating groove of the second heater 12 to 240° C. The method comprises steps of placing a film roll 1 of the PSF films between the bearing roller 16 and the unwinding roller 4, wherein films unwound from the film roll 1 enter the cutting zone formed between the cut resistance apron 3 and the unwinding roller 4; cutting and fiberizing the films to form belt-like multi-filaments which are evenly paved before entering the first drafting zone; primary drawing the multi-filaments in the first drafting zone with a drafting rate of 1.05 before entering the second drafting zone from the rear roller nip through the guiding tunnel of the filament guider 6; heating the multifilament in the heating groove in the second drafting zone at 200° C., wherein inner macromolecules of the nanofibers of filaments are in a high-elastic state as the inner consolidation structure of the nanofibers of the PSF filaments is loosened; secondary drawing the multi-filaments in the high-elastic state in the second drafting zone with a drafting rate of 2; then entering the third drafting zone from the middle roller nip; heating the multifilament in the heating groove in the third drafting zone at 140° C., wherein the inner macromolecules of nanofibers of the filaments are in the high-elastic state; main drawing the multi-filaments in the third drafting zone with a drafting rate of 3; then entering a twisting zone from the front roller nip; gathering and twisting the drafted multi-filaments to form a yarn, passing the yarn through a pig-tail guider 15 of yarn, a ring and a traveler successively, and is finally winding onto a yarn bobbin.

Twist degree of the yarn formed is 85 twists/m, and one PFS filament is randomly removed from an inner of the yarn by untwisting, then the five PFS filaments are observed by a scanning electron microscopy; the observed results show that the PFS filament is mesh-like, continuous and thin with a width of 1.0 mm and a thickness of 0.04 mm; the PFS filament comprises the nanofibers, and finenesses of the nanofibers are in a range of 97-178 nm, enabling producing yarn containing PSF nanofibers.

Embodiment 4

The method to form yarn via film fiberizing spinning with inorganic copper films.

A width of the inorganic copper films is 12 mm, and a thickness is 0.06 mm; the cut resistance apron 3 is made of the super high-strength rubber; a distance between cutter edges of adjacent loop blades is 3 mm; the first heater 9 and the second heater 12 are externally connected to a 36 v safety power supply, so as to heat the heating groove of the first heater 9 to 60° C. and the heating groove of the second heater 12 to 60° C. The method comprises steps of placing a film roll 1 of the inorganic copper films between the bearing roller 16 and the unwinding roller 4, wherein films unwound from the film roll 1 enter the cutting zone formed between the cut resistance apron 3 and the unwinding roller 4; cutting and fiberizing the films to form belt-like multi-filaments which are evenly paved before entering the first drafting zone; primary drawing the multi-filaments in the first drafting zone with a drafting rate of 1.05 before entering the second drafting zone from the rear roller nip through the guiding tunnel of the filament guider 6; heating the multi-filament in the heating groove in the second drafting zone at 60° C., wherein an inner structure of a copper material cannot be loosened, but it is conducive to stretching and extending copper filaments of the belt-like multi-filaments; secondary drawing the multifilament in the second drafting zone with a drafting rate of 1.05; then entering the third drafting zone from the middle roller nip; heating the multifilament in the heating groove in the third drafting zone at 60° C., in such a manner that the filaments are easy to be drafted and extended; main drawing the multi-filaments in the third drafting zone with a drafting rate of 1.05; then entering a twisting zone from the front roller nip; gathering and twisting the drafted multi-filaments to form a yarn, passing the yarn through a pig-tail guider 15 of yarn, a ring and a traveler successively, and is finally winding onto a yarn bobbin. Twist degree of the yarn formed is 60 twists/m, and one copper filament is randomly removed from the inner of the yarn by untwisting, then the copper filament is observed by an optical microscopy; the observed results show that the coper filament is continuous and thin with a width of 0.75 mm and a thickness of 0.05 mm, enabling production of copper fiber yarn.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method to form yarn via film fiberizing spinning, comprising steps of: arranging a film cutting device behind a drafting system on a ring frame, wherein the drafting system comprises a rear roller (8), a rear rubber roller (7), a middle roller (11), a middle rubber roller (10), a front roller (14), and a front rubber roller (13); the film cutting device comprises a bearing roller (16), an unwinding roller (4) and a cutting roller (5); a cut resistance apron (3) is wrapped onto the unwinding roller (4); loop blades, which are arranged in parallel, are located on the cutting roller (5) circumference; the cut resistance apron (3) corresponds to cutter edges of the loop blades located on the cutting roller (5); a cutting zone is formed between the cut resistance apron (3) and the cutting roller (5); centers of the cutting zone, the rear rubber roller (7), the middle rubber roller (10) and the front rubber roller (13) are in a same plane; the rear rubber roller (7) and the rear roller (8) of the drafting system engage with each other to form a rear roller nip; a first drafting zone is formed between the cutting zone and the rear roller nip; a filament guider (6) is provided in the first drafting zone; the middle roller (11) and the middle rubber roller (10) of the drafting system engage with each other to form a middle roller nip; a second drafting zone is formed between the rear roller nip and the middle roller nip; a first heater (9) is provided in the second drafting zone; a heating groove of the first heater (9) is parallel to an axis of the rear roller nip and an axis of the middle roller nip; the front roller (14) and the front rubber roller (13) engage with each other to form a front roller nip; a third drafting zone is formed between the middle roller nip and the front roller nip; a second heater (12) is provided in the third drafting zone; a heating groove of the second heater (12) is parallel to the axis of the middle roller nip and an axis of the front roller nip;

during spinning, placing a film roll (1) between the bearing roller (16) and the unwinding roller (4), wherein films unwound from the film roll (1) enter the cutting zone formed between the cut resistance apron (3) and the cutting roller (5); the film cutting device cuts and fiberizes the films to form belt-like multi-filaments which are evenly paved before entering the first drafting zone, wherein the multi-filaments get a primary drawing; after the primary drawing, the multi-filaments outputting from the rear roller nip via the filament guider (6) enter the second drafting zone, wherein the multi-filaments heated in the heating groove of the first heater (9) get a secondary drawing; after the secondary drawing the multi-filaments outputting from the middle roller nip enter the third drafting zone, wherein the multi-filaments heated in the heating groove of the second heater (12) get a main drawing; after the main drawing, the multi-filaments outputting from the front roller nip are converged and twisted to form a yarn, subsequently the yarn passes through a pig-tail guider (15) of yarn, a ring and a traveler successively, and is finally winding onto a yarn bobbin.

2. The method to form the yarn via the film fiberizing spinning, as recited in claim 1, wherein the cut resistance apron (3) is made of ultra-high-strength polyethylene, aramid, or rubber sufficient to interact with the loop blades.

3. The method to form the yarn via the film fiberizing spinning, as recited in claim 1, wherein a distance between cutter edges of adjacent loop blades is ranged from 0.1 mm to 3 mm.

* * * * *